United States Patent [19]

Foley et al.

[11] Patent Number: 4,791,443

[45] Date of Patent: Dec. 13, 1988

[54] PHOTOGRAPHIC PROCESSOR WITH AUXILIARY POWER SUPPLY

[75] Inventors: Walter D. Foley; Robert J. Blackman, both of Rochester, N.Y.

[73] Assignee: Eastman Kodak Company, Rochester, N.Y.

[21] Appl. No.: 147,061

[22] Filed: Jan. 22, 1988

Related U.S. Application Data

[63] Continuation of Ser. No. 62,303, Jun. 12, 1987, abandoned.

[51] Int. Cl.[4] ..... G03D 3/13

[52] U.S. Cl. ..... 354/321; 354/322; 307/64

[58] Field of Search ..... 354/319, 320, 321, 322; 307/64, 66

[56] References Cited

U.S. PATENT DOCUMENTS

| | | | |
|---|---|---|---|
| 3,483,393 | 12/1969 | Gutzmer | 307/66 |
| 3,807,264 | 4/1974 | Jessop | 83/175 |
| 3,816,768 | 6/1974 | Stein | 307/296 |
| 3,835,745 | 9/1974 | Basu et al. | 82/285 |
| 3,859,638 | 1/1975 | Hume | 340/173 R |
| 3,959,778 | 5/1976 | Brette | 340/172.5 |
| 4,122,359 | 10/1978 | Breikss | 307/64 |
| 4,181,842 | 1/1980 | Elias et al. | 307/66 |
| 4,422,163 | 12/1983 | Oldenkamp | 365/229 |
| 4,466,316 | 8/1984 | Kobayashi et al. | 83/13 |
| 4,476,399 | 10/1984 | Yoshida | 307/64 |
| 4,613,221 | 9/1986 | Takase et al. | 354/321 |

FOREIGN PATENT DOCUMENTS

| | | |
|---|---|---|
| 60-104944 | 6/1985 | Japan . |
| 60-115937 | 6/1985 | Japan . |

*Primary Examiner*—A. A. Mathews

*Attorney, Agent, or Firm*—Jeffrey L. Brandt

[57] ABSTRACT

A photographic film processor having a controller and a drive motor for conveying exposed film from a spool and along a film path through a series of process stations is disclosed. The photographic processor includes: a main power supply and an auxiliary power supply for the processor; a selector switch normally operable to apply main power to the processor and alternatively operable to apply auxiliary power to the processor in the event of an interruption in main power; and a film cutter mechanism including a guillotine blade reciprocable relative to a stationary shear block in the film path, a latch to hold the blade in a ready position, a trip lever responsive to an unwound film spool being pulled against it to release the latch and blade, and a spring to drive the blade through a cutting stroke for cutting the spool from the film, whereby the processor is powered, in the event of an interruption of main power, to finish processing any film which is already in process.

16 Claims, 3 Drawing Sheets

PHOTOGRAPHIC PROCESSOR WITH AUXILIARY POWER SUPPLY

This is a continuation of application Ser. No. 62,303, filed June 12, 1987, now abandoned.

BACKGROUND OF THE INVENTION

1. Field of the Invention

This invention relates generally to mechanized photographic film processors, and more specifically to a photographic film processor incorporating an auxiliary power source.

2. Description of the Prior Art

Processing of photographic film involves a series of steps such as developing, bleaching, fixing, rinsing, and drying. These steps lend themselves to mechanization by conveying long strips of film sequentially through a series of stations or tanks, each one containing a processing liquid appropriate to the process step at that station.

In the current state of the art, an automated photographic film processing apparatus typically employs microcomputer control of its several functions. The prior art includes Japanese patent application No. 213756/1983, laid open as No. 104944/1985 on June 10, 1985; and Japanese patent application No. 223802/1983, laid open as No. 115937/1985 on June 22, 1985. These Japanese publications each disclose an automated, microcomputer-controlled, film processor system. The first of these includes a system wherein a power supply monitor responds to a drop in primary voltage to switch to a back up battery, and also to reset the controllers to prevent runaway. The second includes a system wherein the microcomputer generates a signal for every program cycle. Supervisory apparatus is provided to monitor these signals and, in response to failure thereof, generate a reset signal to a volatile RAM and to inlet and outlet data ports, and an actuating signal to the driving means. All of this is for the purpose of completing a processing cycle despite a microcomputer failure.

The above-cited prior art suffers from the disadvantage that, while provisions are made to provide back-up power to the computer/controllers, no provisions are made for physically completing the processing of film in progress during the power failure. Thus, if the main power is unavailable for any substantial period of time (i.e. more than a few seconds), the film currently being processed will remain stationary in the processing fluid and be ruined.

It would thus be desirable to provide a photographic processor wherein, in the event of a power failure, auxiliary power is supplied to complete the processing of film in progress. Such a processor should function substantially automatically, and should move any film in progress physically through the remaining processing liquids so as to complete its processing in a satisfactory manner.

OBJECTS OF THE INVENTION

The principal object of the present invention is to provide a photographic processor which, in the event of a main power failure, automatically completes the processing of any film in progress during the power failure.

Another object of the present invention is to provide a photographic processor which, in the event of a main power failure, automatically provides auxiliary power so as to complete the processing of any film in progress without requiring any operation intervention.

A further object of the present invention is to provide a photographic processor which, in the event of a main power failure, automatically completes the processing of any film in progress including separating the film from a holder using a mechanical device which places a minimum demand on an auxiliary power source.

SUMMARY OF THE INVENTION

In accordance with the present invention, there is provided a new and improved apparatus for processing photographic material, the apparatus comprising a plurality of processing stations, each including a processing liquid. Means are provided for moving the photographic material through the processing liquids. Means connectable to an external source of power are provided for supplying main power, and means are provided for supplying auxiliary power. Switching means are provided for normally applying the main power to the moving means, the switching means being actuatable to apply the auxiliary power to the moving means. Means responsive to an interruption in the main power are provided for actuating the switching means to apply the auxiliary power to the moving means.

In one embodiment of the invention, the photographic material comprises an elongate strip contained on a spool. Mechanically actuated cutting means are provided for separating the photographic material from the spool when the spool is substantially empty of the photographic material.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing figures, in which like reference numerals are carried forward, and in which:

DESCRIPTION OF THE PREFERRED EMBODIMENT

Figure 1:
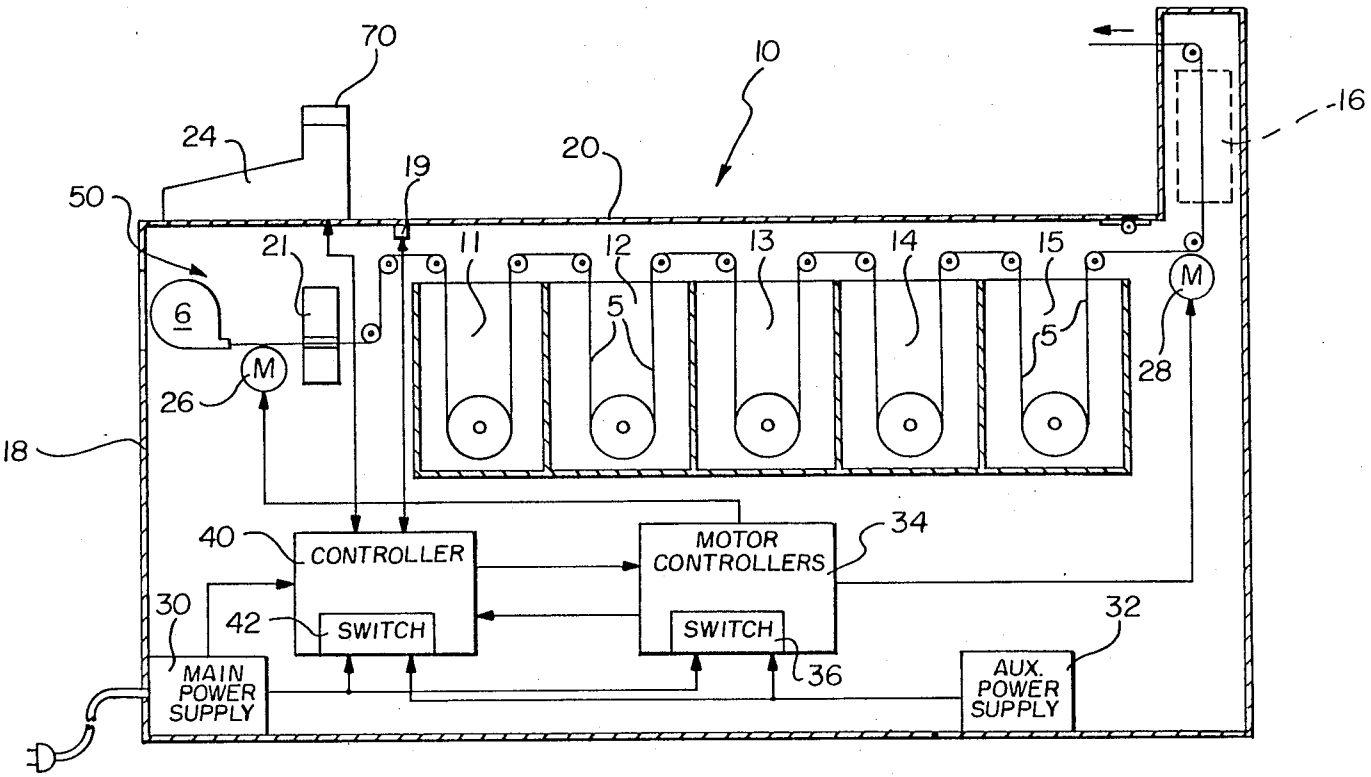
FIG. 1 is a partially schematic side elevation view of a film processor constructed in accordance with the present invention.

Referring to FIG. 1, a film processor 10 includes a plurality of film processing tanks or stations 11–15, each containing a processing liquid appropriate to the process step at that station. A filmstrip 5 is shown traversing the processor 10 in a serpentine path through the several tanks from left to right, in which the exposed film is sequentially developed, bleached, fixed, rinsed, etc. After leaving the last such tank 15, the filmstrip 5 is drawn through a dryer 16, and leaves the processor.

Controls

The film processor 10 is housed in a suitable cabinet or housing 18 having a hinged cover 20 providing access to its interior. Cover 20 is locked during operation of the system by a cover lock 19. A control panel 24, including a display and keyboard, is mounted on the housing. An input motor 26 and a driver motor 28 are mounted within the housing for operative connection to the control system and to the film being processed. A film cutter mechanism 50 is housed at the input end of the system.

The control system is represented in block form and includes a main power supply 30, an auxiliary power supply 32, motor controllers 34 connected to the power supplies by a switch 36, and a microprocessor or controller 40 connected to the power supplies by a selector switch 42. Motor controllers 34 are operatively connected to the input and drive motors 26 and 28. Microprocessor 40 is operatively connected to the control panel 24, to cover lock 19, and to film sensors 21 at the input station, in addition to the main and auxiliary power supplies 30 and 32.

Figure 2:
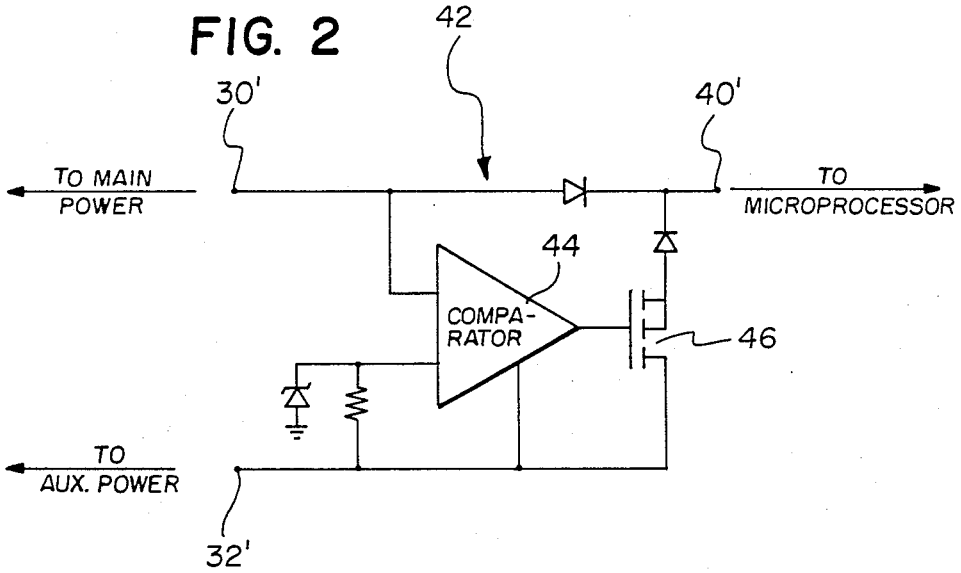
FIG. 2 is a schematic circuit diagram of switch 42 of FIG. 1.

Referring to FIG. 2, the selector switch 42 of FIG. 1 is shown in schematic form. Switch 42 includes a comparator 44 between the connections to main power 30 and auxiliary power 32, and a transistor switch 46. In switch 42, the magnitude of main power is continually compared with that of the auxiliary power which is standing by. When the level of main power drops below a preselected level, the transistor 46 is activated to switch auxiliary power into connection with the microprocessor.

Figure 3:
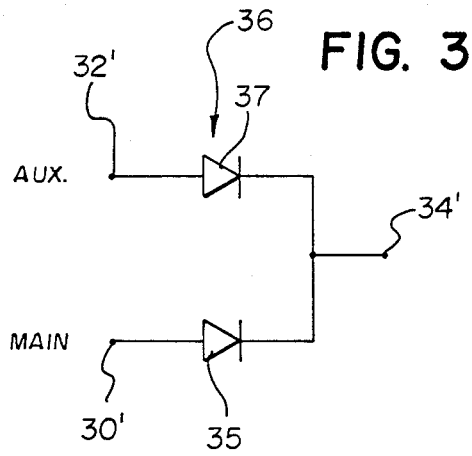
FIG. 3 is a schematic circuit diagram of swtich 36 of FIG. 1.

FIG. 3 is a schematic circuit diagram of switch 36 of FIG. 1, showing a diode 35 in the path from main power 30 to the motor controller 34, and a diode 37 in the path from auxiliary power 32 to the motor controller.

Film Cutting

Figure 4:
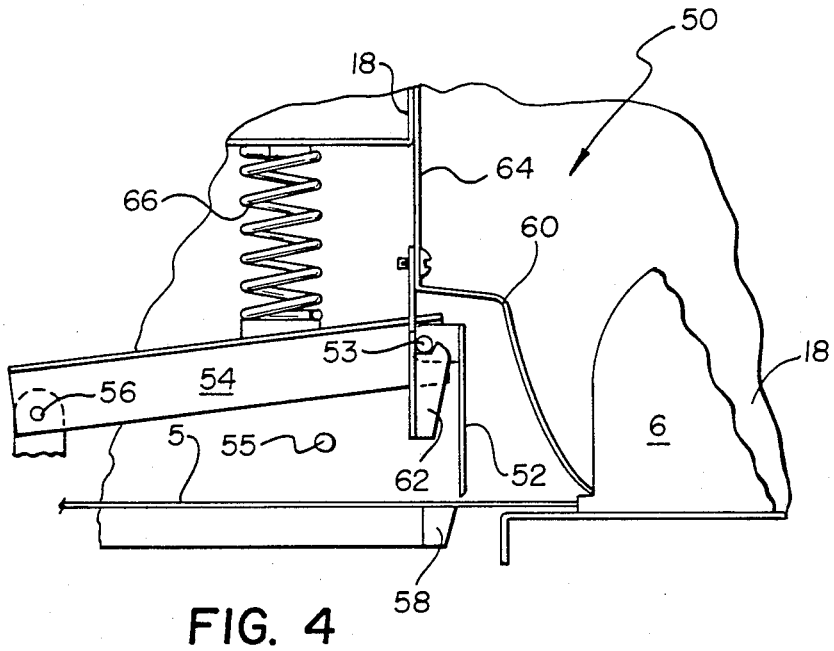
FIG. 4 is a side view of a film cutting mechanism in a first position prior to cutting.
Figure 5:
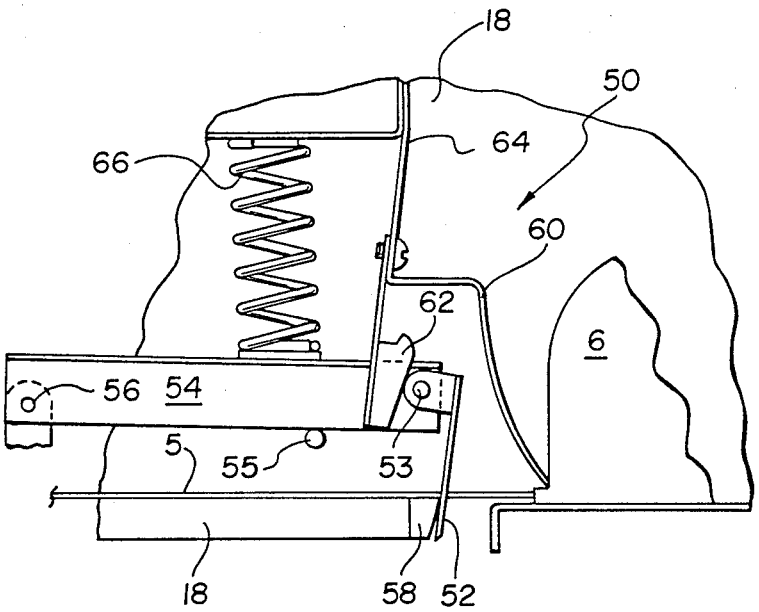
FIG. 5 is a view similar to FIG. 4, with the cutting mechanism in a second position immediately after a cut.

A mechanical film cutter mechanism is shown in FIG. 4 prior to a cutting stroke, and in FIG. 5 in the completion of a cutting stroke. The cutter mechanism is generally indicated at 50 and is mounted with reference to the stationary housing 18 which is represented schematically at various points in FIGS. 4 and 5. Cutter 50 includes a guillotine blade 52 mounted by a pin 53 on a lever arm 54 which is in turn pivoted on the housing at a pivot mount 56. Blade 52 is adapted for up and down reciprocation relative to a stationary shear block 58 which is also fixed to the housing 18. The bottom limit of the stroke of blade 52 is established by a stationary abutment 55 on which the lever arm 54 rests at the end of its cutting stroke.

A blade mechanism for setting, tripping, and driving the guillotine blade includes a trip lever 60 and a latch 62, both depending from a resilient leaf spring 64 attached to the housing. A compression spring 66 is positioned between the top of the lever arm 54 and the housing 18. and is shown in compression in FIG. 4 and extended in FIG. 5. Blade 52 is set and held in its retracted position by means of the pin 53 nesting in latch 62.

In FIG. 4, a filmstrip is being pulled from a film cartridge 6 which is resting on the housing 18 and which bears lightly against the trip lever 60 while film is being unwound or pulled from the cartridge. When there is no more film on the cartridge to unwind, the filmstrip 5 pulls the empty (but still attached) cartridge 6 hard against the trip lever 60, moving the latch 62 away from the blade pin 53 and allowing the spring 66 to drive the blade 52 downward, shearing the filmstrip 5 in cooperation with the shear block 58.

FIG. 5 shows the bottom of the cutting stroke at the instant after impact. The filmstrip 5 is now free of the cartridge and will be pulled through the processor. Motor 26 is then operated, via mechanical connections (not shown), to return the now empty cartridge 6, and reset blade 52. Alternatively, lever arm 54 can be raised manually to reset the blade on the latch 62, and when this is done, the cartridge 6 will be ejected by the trip lever 60 and leaf spring 64 as they spring back to their FIG. 4 positions. With the cutter mechanism thus reset, the apparatus is ready for another full cartridge of exposed film to be placed in the opeative position that was just occupied by cartridge 6.

Operation

In operation, in the event of a main power failure, the selector switch 42 senses the main power failure and switches over to the auxiliary power source. The auxiliary power source 32 then supplies power to the microprocessor 40, drive motor 28, cover lock 19, input motor 26, and film sensors 21. Any film which is already in process within the system continues to completion. Film which is still feeding into the system from a cartridge reaches the end of its roll and is cut by the spring actuated cutter mechanism. The film sensors 21 then sense the absence of film and notify the microprocessor. The microprocessor allows for the processing of this last film to completion, and then shuts down the drive motor. Finally, the microprocessor notifies the operator, by means of the display and/or an audible power-off alarm 70, to shut down all power to the entire system.

What is claimed is:

1. Apparatus for processing photographic material comprising:

a plurality of processing stations, each including a processing liquid;

means for moving said photographic material through said processing liquids;

means connectable to an external source of power for supplying main power;

means for supplying auxiliary power;

switching means for normally applying said main power to said moving means, said switching means being actuatable to apply said auxiliary power to said moving means; and means responsive to an interruption in said main power for actuating said switching means to apply said auxiliary power to said moving means.

2. Apparatus in accordance with claim 1 wherein said moving means includes at least one motor and an associated motor controller.

3. Apparatus in accordance with claim 1 and further including a microprocessor connected to said switching means for receiving said main or said auxiliary power.

4. Apparatus in accordance with claim 1 and further including an alarm powered by said auxiliary power for notifying an operator in the event of failure of said main power.

5. Apparatus in accordance with claim 1 wherein said apparatus comprises a photographic film processor and said photographic material comprises an elongate strip of exposed photographic film.

6. Apparatus for processing an elongate strip of photographic material contained on a spool, comprising:

a plurality of processing stations, each including a processing liquid;

means for moving said photographic material off of said spool and through said processing liquids;

means connectable to an external source of power for supplying main power;

means for supplying auxiliary power;

switching means for normally applying said main power to said moving means, said switching means being actuatable to apply said auxiliary power to said moving means;

means responsive to an interruption in said main power for actuating said switching means to apply said auxiliary power to said moving means; and mechanically actuated cutting means for separating said photographic material from said spool when said spool is substantially empty of said photographic material.

7. Apparatus in accordance with claim 6 wherein said mechanically actuated cutting means comprises:

a stationary shear block in the path of said photographic material; and a guillotine blade reciprocal relative to said stationary shear block for cutting said photographic material.

8. Apparatus in accordance with claim 7 wherein said mechanically actuated cutting means further comprises:

latch means to hold said blade in a position ready to cut said photographic material;

trip lever means responsive to force applied to it by said spool for actuating said latch means to release said blade; and means for driving said blade to cut said photographic matreial from said spool.

9. Apparatus in accordance with claim 8 wherein said driving means comprises a compression spring.

10. Apparatus in accordance with claim 6 wherein said moving means includes at least one motor and an associated motor controller.

11. Apparatus in accordance with claim 6 and further including a microprocessor connected to said switching means for receiving said main or said auxiliary power.

12. Apparatus in accordance with claim 6 and further including an alarm powered by said auxiliary power for notifying an operator in the event of failure of said main power.

13. Apparatus in accordance with claim 6 wherein said apparatus comprises a photographic film processor and said photographic material comprises exposed photographic film.

14. A method of operating apparatus for processing photographic material, said apparatus including a plurality of processing stations, each of said processing stations including a processing liquid, means for moving said photographic material through said processing liquids, means connectable to an external source of power for supplying main power, and means for supplying auxiliary power, said method comprising the steps of:

normally applying said main power to said moving means; and applying said auxiliary power to said moving means in the event of an interruption in said main power.

15. A method in accordance with claim 14 wherein said apparatus comprises a photographic film processor and said photographic material comprises exposed photographic film.

16. A method in accordance with claim 14 wherein said photographic material comprises an elongate strip contained on a spool, and further including the step of:

cutting said strip, using a mechanically actuated cutting means, to separate the end of said strip from said spool.

* * * * *